US006264395B1

(12) United States Patent
Allamon et al.

(10) Patent No.: US 6,264,395 B1
(45) Date of Patent: Jul. 24, 2001

(54) SLIPS FOR DRILL PIPE OR OTHER TUBULAR GOODS

(75) Inventors: Jerry P. Allamon, 34 Naples La., Montgomery, TX (US) 77356; Jack E. Miller, Houston, TX (US)

(73) Assignees: Jerry P. Allamon; Shirley C. Allamon, both of Houston, TX (US)

( * ) Notice: Subject to any disclaimer, the term of this patent is extended or adjusted under 35 U.S.C. 154(b) by 0 days.

(21) Appl. No.: 09/596,489

(22) Filed: Jun. 19, 2000

Related U.S. Application Data

(60) Provisional application No. 60/180,361, filed on Feb. 4, 2000.

(51) Int. Cl.[7] ..... B25G 3/20; F16B 2/00; F16B 7/04

(52) U.S. Cl. ..... 403/367; 285/123.5

(58) Field of Search ..... 403/367, 297, 403/298; 285/141–148, 123.5–123.11; 175/423

(56) References Cited

U.S. PATENT DOCUMENTS

| | | | |
|---|---|---|---|
| Re. 23,842 | 6/1954 | Moore | 252/23 |
| 565,843 | 8/1896 | Curtin . | |
| 823,974 | 6/1906 | Shaw . | |
| 1,058,577 | 4/1913 | Gardner . | |
| 1,149,034 | 8/1915 | Despain . | |
| 1,298,619 | 3/1919 | Wright . | |
| 1,341,410 | 5/1920 | Black . | |
| 1,414,951 | 5/1922 | Hosmer et al. . | |
| 1,422,289 | 7/1922 | Moody . | |
| 1,442,663 | 1/1923 | Halley . | |
| 1,481,378 | 1/1924 | Le Bus . | |
| 1,482,693 | 2/1924 | Mollenberg . | |
| 1,501,962 | 7/1924 | Montgomery . | |
| 1,503,523 | 8/1924 | Thomas et al. . | |
| 1,506,581 | 8/1924 | Halley . | |
| 1,535,689 | 4/1925 | Schwimmer . | |
| 1,543,904 | 6/1925 | Carr . | |
| 1,555,379 | 9/1925 | Moody . | |
| 1,560,701 | 11/1925 | Layton . | |
| 1,574,404 | 2/1926 | Moody . | |
| 1,611,599 | 12/1926 | Livergood . | |
| 1,625,540 | 4/1927 | Hertzberg . | |
| 1,637,056 | 7/1927 | Segelhorst . | |
| 1,643,750 | 8/1927 | Pearson et al. . | |
| 1,659,639 | 1/1928 | Smith . | |
| 1,659,783 | 2/1928 | Pearce . | |
| 1,685,284 | 9/1928 | Harding . | |
| 1,704,057 | 3/1929 | Neilsen . | |
| 1,719,533 | 7/1929 | Cady . | |
| 1,725,666 | 8/1929 | Morrow . | |
| 1,730,622 | 10/1929 | O'Brien . | |
| 1,737,893 | 12/1929 | Reed . | |
| 1,750,822 | 3/1930 | Spalding . | |
| 1,758,108 | 5/1930 | Goeser . | |
| 1,763,872 | 7/1930 | Uhrig . | |
| 1,776,043 | 9/1930 | Reed . | |
| 1,794,273 | 2/1931 | Black . | |
| 1,795,578 | 3/1931 | Smith . | |

(List continued on next page.)

*Primary Examiner*—Lynne B. Browne
*Assistant Examiner*—John B. Walsh
(74) *Attorney, Agent, or Firm*—McGlinchey Stafford; Clarence E. Eriksen

(57) ABSTRACT

Slip assemblies are provided for gripping drill pipe or other tubulars such that the load is distributed along the length of the dies of the slip segments rather than being concentrated at the lowermost dies within the slip segments. The load is distributed by the fact of using a load ring around the interior surface of each slip segment to allow the load ring to absorb part of the loading rather than have all of the load supported by the lowermost slip dies. In addition, resilient members are provided at the top surface of the uppermost die and also at the top surface of the die immediately underneath the load ring to better distribute the loading between the various slip dies and also to lessen the possibility of having gaps develop between the dies of the slip segments.

13 Claims, 7 Drawing Sheets

U.S. PATENT DOCUMENTS

| | | | | |
|---|---|---|---|---|
| 1,797,964 | | 3/1931 | Pearce . | |
| 1,802,156 | | 4/1931 | O'Brien . | |
| 1,820,479 | | 8/1931 | O'Brien . | |
| 1,823,183 | | 9/1931 | Angell . | |
| 1,836,680 | | 12/1931 | Nixton . | |
| 1,838,439 | | 12/1931 | O'Brien . | |
| 1,847,087 | | 3/1932 | Greve . | |
| 1,849,102 | | 3/1932 | Livergood . | |
| 1,851,009 | | 3/1932 | Hoffoss . | |
| 1,858,324 | | 5/1932 | Decker . | |
| 1,860,062 | | 5/1932 | Taylor . | |
| 1,864,111 | | 6/1932 | Young . | |
| 1,864,953 | | 6/1932 | Standlee . | |
| 1,874,440 | | 8/1932 | Bush . | |
| 1,883,073 | | 10/1932 | Stone . | |
| 1,889,592 | | 11/1932 | Brandt . | |
| 1,907,685 | * | 5/1933 | Tilbury . | |
| 1,909,601 | * | 5/1933 | Young et al. . | |
| 1,920,617 | * | 8/1933 | Young et al. | 24/263 |
| 1,923,283 | * | 8/1933 | Stokes | 24/263 |
| 1,933,172 | * | 10/1933 | Humason | 24/263 |
| 1,952,595 | * | 3/1934 | Johnson | 24/263 |
| 1,966,454 | * | 7/1934 | Moody | 24/263 |
| 1,966,693 | * | 7/1934 | Tilbury | 24/263 |
| 1,979,289 | * | 11/1934 | Howard | 24/263 |
| 1,999,279 | * | 4/1935 | Burns et al. | 24/263 |
| 2,010,938 | * | 8/1935 | Abegg | 24/263 |
| 2,012,329 | * | 8/1935 | Wickersham et al. | 24/263 |
| 2,012,337 | * | 8/1935 | Burns et al. | 24/263 |
| 2,023,663 | * | 12/1935 | Burns et al. | 24/263 |
| 2,030,499 | * | 2/1936 | Church | 24/263 |
| 2,048,209 | * | 7/1936 | Young et al. | 24/263 |
| 2,061,772 | * | 11/1936 | McLagan | 24/263 |
| 2,063,361 | * | 12/1936 | Baash | 24/263 |
| 2,065,130 | | 12/1936 | Grau et al. | 24/263 |
| 2,065,140 | | 12/1936 | Lundeen | 24/263 |
| 2,071,637 | | 2/1937 | Laurent | 24/263 |
| 2,085,237 | | 6/1937 | Todd | 24/263 |
| 2,109,493 | | 3/1938 | Lundeen | 24/263 |
| 2,119,731 | | 7/1938 | Abegg | 24/263 |
| 2,131,400 | | 9/1938 | Johnson et al. | 24/263 |
| 2,134,468 | | 10/1938 | Bashara | 24/263 |
| 2,143,615 | | 1/1939 | Abegg | 24/263 |
| 2,143,849 | | 1/1939 | Gordy, Jr. | 24/263 |
| 2,144,146 | | 1/1939 | Driscoll | 24/263 |
| 2,151,208 | | 3/1939 | Hiniker | 24/263.5 |
| 2,153,770 | | 4/1939 | Nixon | 24/263 |
| 2,156,384 | | 5/1939 | Fluellen | 24/263 |
| 2,184,231 | | 12/1939 | Allen | 24/263 |
| 2,208,926 | | 7/1940 | Fluellen | 24/263 |
| 2,231,923 | | 2/1941 | Koen | 24/263 |
| 2,245,979 | | 6/1941 | Johnson | 24/263.5 |
| 2,259,054 | * | 10/1941 | Young | 24/263 |
| 2,282,758 | * | 5/1942 | Gallagher | 24/263 |
| 2,283,082 | * | 5/1942 | Miether | 24/263 |
| 2,287,432 | * | 6/1942 | Kinzbach | 24/263 |
| 2,288,851 | * | 7/1942 | Sharp | 24/263 |
| 2,293,974 | * | 8/1942 | Eckel | 166/1 |
| 2,303,312 | * | 11/1942 | Sheffield | 254/30 |
| 2,319,016 | * | 5/1943 | Taylor | 24/263 |
| 2,340,597 | * | 2/1944 | Kelley | 24/263 |
| 2,351,887 | * | 6/1944 | Steadman | 255/23 |
| 2,545,177 | * | 3/1951 | True | 24/263 |
| 2,545,627 | * | 3/1951 | Moore | 255/23 |
| 2,552,618 | * | 5/1951 | Boatright | 24/263 |
| 2,570,039 | * | 10/1951 | Stone | 24/263 |
| 2,573,318 | * | 10/1951 | Dow | 40/125 |
| 2,575,649 | * | 11/1951 | Abegg | 24/263 |
| 2,589,159 | * | 3/1952 | Stone | 255/23 |
| 2,609,583 | * | 9/1952 | Barber et al. | 24/263 |
| 2,612,671 | * | 10/1952 | Martin | 24/263 |
| 2,662,737 | * | 12/1953 | Edelberg | 255/23 |
| 2,698,734 | * | 1/1955 | Tremolada et al. | 255/23 |
| 2,700,201 | * | 1/1955 | Bannister | 24/263 |
| 2,785,454 | * | 3/1957 | Young | 24/263 |
| 2,810,178 | * | 10/1957 | Taylor | 24/263 |
| 2,810,551 | * | 10/1957 | Long | 255/23 |
| 2,810,552 | * | 10/1957 | Martin | 255/23 |
| 2,814,087 | * | 11/1957 | Palmer | 24/263 |
| 2,814,461 | * | 11/1957 | Martin | 255/23 |
| 2,839,164 | * | 6/1958 | Roussel | 188/67 |
| 2,874,436 | * | 2/1959 | Allen | 24/263 |
| 2,874,437 | * | 2/1959 | Anderson | 24/263 |
| 2,887,754 | * | 5/1959 | Johnson | 24/263 |
| 2,890,513 | * | 6/1959 | Lane | 24/263 |
| 2,896,292 | * | 7/1959 | Kinzbach | 24/249 |
| 2,905,998 | * | 9/1959 | Acker, Jr. | 24/254 |
| 2,908,514 | * | 10/1959 | Davis | 285/146 |
| 2,970,445 | | 2/1961 | Suderow | 61/46.5 |
| 3,017,936 | | 1/1962 | Long | 175/197 |
| 3,019,502 | | 2/1962 | Walker | 24/263 |
| 3,025,582 | | 3/1962 | Taylor | 24/263 |
| 3,029,488 | | 4/1962 | Knights | 24/263 |
| 3,032,366 | | 5/1962 | Meek | 294/102 |
| 3,052,943 | | 9/1962 | Jones | 24/263 |
| 3,095,627 | | 7/1963 | Johnson | 24/263 |
| 3,096,075 | | 7/1963 | Brown | 254/29 |
| 3,096,554 | | 7/1963 | Johnson | 24/263 |
| 3,097,409 | | 7/1963 | Kelley | 24/263 |
| 3,122,822 | | 3/1964 | Gilreath | 24/263 |
| 3,140,523 | | 7/1964 | Taylor | 24/263 |
| 3,149,391 | | 9/1964 | Boster | 24/263 |
| 3,156,026 | | 11/1964 | Kelley | 24/263 |
| 3,210,821 | | 10/1965 | Spiri et al. | 24/263 |
| 3,268,968 | | 8/1966 | Crickmer | 24/263 |
| 3,268,969 | | 8/1966 | Turner | 24/263 |
| 3,270,389 | | 9/1966 | Kingsbury | 24/263 |
| 3,348,277 | | 10/1967 | Crickmer | 24/263 |
| 3,349,455 | | 10/1967 | Doherty | 24/263 |
| 3,353,235 | | 11/1967 | Adams | 24/263 |
| 3,358,341 | | 12/1967 | Burstall | 24/263 |
| 3,365,762 | | 1/1968 | Spiri | 24/263 |
| 3,367,002 | | 2/1968 | Johnson | 124/263 |
| 3,422,506 | | 1/1969 | Turner | 24/263 |
| 3,443,291 | | 5/1969 | Doherty | 24/263 |
| 3,454,289 | | 7/1969 | Flowler | 285/144 |
| 3,457,605 | | 7/1969 | Kingsbury et al. | 24/263 |
| 3,472,535 | | 10/1969 | Kinley | 285/145 |
| 3,513,511 | | 5/1970 | Crickmer | 24/263 |
| 3,514,822 | | 6/1970 | Guier | 24/263 |
| 3,531,836 | | 10/1970 | Crickmer | 24/263 |
| 3,571,865 | | 3/1971 | Johnson | 24/263 |
| 3,579,752 | | 5/1971 | Brown | 24/263 |
| 3,579,753 | | 5/1971 | Pryor | 24/263 |
| 3,675,278 | | 7/1972 | Powell | 24/249 |
| 3,739,434 | | 6/1973 | Wheeler | 24/249 |
| 3,742,563 | | 7/1973 | Brown | 24/263 |
| 3,742,582 | | 7/1973 | Broske | 29/421 |
| 3,748,702 | | 7/1973 | Brown | 24/263 |
| 3,846,877 | | 11/1974 | Spiri | 24/263 |
| 3,961,399 | | 6/1976 | Boyadjieff | 24/263 |
| 3,999,260 | | 12/1976 | Stuckey et al. | 24/263 |
| 4,093,042 | | 6/1978 | Prodon | 188/67 |
| 4,203,182 | | 5/1980 | Boyadjieff | 24/263 |
| 4,253,219 | | 3/1981 | Krasnov | 24/263 |
| 4,269,277 | | 5/1981 | Baugh | 173/149 |
| 4,275,487 | | 6/1981 | Gray et al. | 24/263 |
| 4,275,488 | | 6/1981 | Gray et al. | 24/263 |
| 4,281,535 | | 8/1981 | Wesch | 73/49.8 |
| 4,306,339 | | 12/1981 | Ward | 24/263 |
| 4,306,742 | | 12/1981 | Hardcastle | 285/147 |

| | | | | |
|---|---|---|---|---|
| 4,332,062 | | 6/1982 | Byrne | 24/263 |
| 4,333,209 | * | 6/1982 | Herst | 24/263 |
| 4,351,090 | * | 9/1982 | Clements et al. | 24/263 |
| 4,355,443 | * | 10/1982 | Blackwell | 24/263 |
| 4,361,940 | * | 12/1982 | McFadden | 24/263 |
| 4,389,760 | * | 6/1983 | Krasnov | 24/263 |
| 4,415,193 | * | 11/1983 | Carlberg | 294/102 |
| 4,450,606 | * | 5/1984 | Broussard | 188/67 |
| 4,511,168 | * | 4/1985 | Haynes | 294/102.2 |
| 4,576,254 | * | 3/1986 | Cox | 188/67 |
| 4,681,193 | * | 7/1987 | Crowe | 188/67 |
| 4,711,326 | * | 12/1987 | Baugh | 188/67 |
| 4,715,456 | * | 12/1987 | Poe et al. | 175/423 |
| 4,791,997 | * | 12/1988 | Krasnov | 175/57 |
| 4,823,919 | * | 4/1989 | Hayatdavoudi | 188/67 |
| 4,934,869 | * | 6/1990 | Brandon et al. | 405/199 |
| 4,940,118 | * | 7/1990 | Cox | 188/67 |
| 5,027,926 | * | 7/1991 | Cox | 188/67 |
| 5,131,692 | * | 7/1992 | Lemons | 285/334.2 |
| 5,174,397 | * | 12/1992 | Currington | 174/423 |
| 5,188,401 | * | 2/1993 | Staniforth | 285/322 |
| 5,240,076 | * | 8/1993 | Cromar et al. | 166/382 |
| 5,335,756 | | 8/1994 | Penisson | 188/67 |
| 5,451,084 | | 9/1995 | Jansch | 294/1.1 |
| 5,484,040 | | 1/1996 | Penisson | 188/67 |
| 5,609,226 | | 3/1997 | Penisson | 188/67 |
| 5,848,647 | | 12/1998 | Webre et al. | 166/379 |
| 5,971,086 | | 10/1999 | Bee et al. | 175/423 |
| 5,992,801 | | 11/1999 | Torres | 248/49 |
| 6,089,338 | | 7/2000 | Bouligny | 175/423 |

* cited by examiner

SLIPS FOR DRILL PIPE OR OTHER TUBULAR GOODS

CROSS-REFERENCE TO RELATED APPLICATION

This application claims the benefit of the fling date of U.S. Provisional Patent Application Ser. No. 60/180,361, filed Feb. 4, 2000.

FIELD OF THE INVENTION

This invention generally pertains to apparatus for holding pipe or other tubular goods in a vertical position and, more particularly, to such apparatus which is useful in oilfield operations for drilling, setting casing or placing or removing any tubular goods from a wellbore. Even more particularly, the purpose of this invention is to improve the strength of commercially available drill pipe slip assemblies and to develop a method to manufacture new drill pipe slip assemblies with improved strength.

In the drilling or workover of oil and gas wells, it is necessary to thread together numerous links of tubular goods, or pipe. These could form either a drill string which rotates a bit at the bottom thereof, or a pipe conduit such as production tubing or well casing which is placed and cemented in the wellbore to prevent its walls from collapsing. In the drilling operation, at least some of the weight of the pipe string extending into the wellbore is supported by a traveling block and tackle arrangement from a derrick which extends upwardly from the floor of the drilling rig.

When it is necessary to add or remove additional pipe to or from the top end of the drill string, the rotary motion of the drill string is stopped and it is suspended at the floor of the drilling rig while an additional pipe section is threadedly connected to the uppermost pipe section in the drill string. Alternatively, it may be unthreaded and removed from the uppermost pipe section in the drill string. In these instances, the drill string is typically suspended by a slip assembly which is mounted in the floor of the drilling rig and through which the drill string extends downwardly Into the wellbore. Referring to FIG. 1, a prior art slip assembly comprises a slip bowl 56 which is typically installed in a table bushing 57 and which has a tapered inner surface having a cylindrical hole through which the pipe 60 at the upper end of the drill string extends. The slip assembly usually also includes a plurality of slip segments 74, typically three, having external tapered surface 74(*a*), which conform to the shape of the inner surface of slip bowl 56 as shown in FIG. 1. Each such slip segment has a plurality of dies, together forming an internal cylindrical surface within the assembly. Thus, each slip segment includes gripping elements directed toward the pipe to be contained within the slip assembly. When the pipe is lowered within the interior of the slip assembly, a camming action between the slip segments of the assembly, and their respective dies, forces the slip segments, and their respective dies inwardly into the pipe, thus gripping it and suspending it from the slip assembly.

When drill pipe is so suspended, an additional joint of pipe may be threadably engaged with the uppermost pipe section on the drill string. The slip segments are then removed from the slip bowl so that the dies are not in engaging contact with the pipe, and rotary motion is imparted to the drill string to continue drilling.

Also during the drilling operation it may be necessary to remove the drill string to change the bit, to add casing to a portion of the well, or for other reasons. While removing the drill string, rotary motion is stopped and the drill string is suspended in the slip assembly. Thereafter, an elevator which is suspended from the traveling block, in the block and tackle arrangement mentioned previously, is used to grip the pipe just above the slip assembly and the slip segment dies of the slip assembly are disengaged. The traveling block is then raised, the slip segments are reinstalled and the stand pipe extending above the drilling rig floor may be unthreaded and removed. Thereafter, the elevator grasps the pipe extending from the slip assembly, the slip segments are again released from contact, and the traveling block again raised. This process may be repeated until the drill string is entirely removed from the wellbore.

Drill pipe slip assemblies are designed to allow supporting of an oil well drill string at virtually any location along the length of the drill string. In this way, the drill pipe and suspended weight can be repeatedly moved up or down and secured structurally to the drill floor as needed during drilling operations. The slip assemblies are typically composed of a "bowl" which is located in the rotary table that includes a tapered bore. The tapered bore is such that the bowl is smaller in diameter at the bottom than the top. Within the tapered bore, a plurality of (typically three) long circumferential gripping assembly segments are located that are formed with an outer taper that matches the tapered bore of the bowl. These slip segments are interconnected by hinges so that the segments maintain a consistent axial relation to one another and may be simply opened and lifted away from the pipe by rig workers when not needed.

The slip segments with gripping assemblies, when installed in the slip bowl, form a cylindrical hole in the center that is roughly the same size as the drill pipe body which is manually lowered into the annular area between the bowl and the drill string when it is desired to suspend the drill string. The assembly naturally grips onto the pipe as it is wedged in the annular taper angle formed between the bowl and the slip segments.

Within each circumferential slip segment, multiple hardened "dies" are located for contact with the drill pipe surface. In one known example, there are three axial rows of six dies for a total of 18 hardened dies secured within each slip segment. These hardened dies typically include "tooth" profiles on the pipe interface surface that enhance the gripping capability of the dies on the pipe by actually penetrating the pipe surface slightly. The hardened dies are necessary because the contact stresses with the pipe can be quite high and the dies are subject to considerable wear.

As the oil industry seeks to drill in ever-deeper offshore waters, the length and weight of the longest drill strings in service have increased accordingly as well as the weight of the suspended loads such as casing strings and liners. As a result of the high repeated loads experienced in many of the deep well applications, bothersome cracking has been noted in the slip segments in the critical "nose" areas that support the loads from the dies. If these cracks are allowed to grow to the point of complete failure to support the dies, the result could be the loss of the drill string downhole as well as loss of the suspended load. This could result in huge remedial costs, or complete loss of the well.

Drilling supervisors choose to replace the slip assemblies at the first sign of cracking, usually in the nose area, to prevent the worst failure scenario from occurring. This is expensive and time consuming.

The problem we have found is in the conventional method used to secure the dies with the three slip segments. The conventional practice for securing the dies is to machine axial "dovetail" shaped grooves in the slip segments. The hardened dies are formed with a mating profile to the dovetail grooves so that the dies may be simply inserted into the dovetail grooves and stacked on top of one another. In a typical slip segment, there are three internal longitudinal dovetail grooves each containing six "stacked" dies. A segmented die retainer ring is bolted above the top die in each groove so as to contain the dies from upward movement and release from their respective grooves.

This arrangement allows the dies to be quickly changed, a welcome convenience feature. However, this arrangement also relies on the load from each die to be supported by the die immediately below it such that, within each axial row, the load accumulates such that the supporting slip segment material below the lowest die (critical nose region) carries the load from he entire set of dies in each axial row.

Another problem with this construction is that the dies have some "slack" or free movement axially in the dovetail grooves and the friction resulting between individual dies and the groove walls may prevent any given die from being in contact with the die above or below it. The problem is as follows: Suppose that the dies set in one axial groove are stacked tightly one upon another; further suppose that the dies set in an adjacent groove are not tightly stacked such that random gaps appear between the individual dies. This could be a result of friction or contamination. Now, if the pipe is inserted and the pipe is pulled downward, the tightly stacked dies will grip the pipe and stop its relative movement with the slip assembly. Since the movement may not have been enough to cause the random gaps to disappear between the dies in the adjacent row, then the vertical loads that would have been carried by those spaced dies cannot since there is no contact with the dies immediately below. This means that the row containing the tightly stacked dies will carry more than a proportional share of the pipe load. This will increase the local loads applied to the part of the slip assembly immediately below the tightly stacked dies. This phenomenon will increase the likelihood of cracking and failure of the "nose" structure of the slip assembly.

We have developed a set of modifications that can be used to correct the two noted problems with the construction of conventional slips. That is, our modifications will prevent the accumulation of all die loading at the bottom of the lowest die and a resilient material is used to press on the dies to ensure that random gaps do not occur between dies. These modifications will cause the load to be more evenly distributed through the structure of the slip segments and thus educe the likelihood of cracking in the "nose" area of the segments.

SUMMARY OF THE INVENTION

The slip assembly of the present invention comprises a slip bowl having an external surface which is tapered from a larger opening at the upper end thereof to a smaller opening at the lower end thereof. A set of slip segments are receivable in the bowl. The slip segments have inwardly tapered, exterior surfaces which ride on the bowl inner surface when the segments are received therein, for clamping a pipe or tubular goods as the pipe is lowered into the interior of the slip assembly. The set of slip segments ride with their respective lower ends supported by a shoulder cut into the slip bowl. A load ring is attached to and rides in a groove circumferentially cut into each of the slip segments of the slip assembly. A load ring is attached to each slip segment by attaching means, such as bolts, and rides in the circumferential groove cut into the inner surface of each of the slip segments. A reverse angle in the circumferential groove combats the tendency of the segmented load ring to move out of the circumferential groove. A retainer ring is fitted to the top of each of the slip segments and a resilient insert on top of the dies nearest the retainer ring urges the dies downwardly into engagement with the load ring. Similarly, a resilient insert on the top of each of the lower set of dies urges them downwardly into their retaining shoulder on the bowl.

This construction assures a more uniform distribution of the load carried by each individual slip segment and their respective dies in the improved tubular goods handling slip assembly of the present invention. Uniform load distribution is therefore more readily achievable than heretofore with the use of the improved apparatus of the present invention.

The invention will be better understood by reference to the following detailed description thereof when taken in conjunction with the accompanying drawings.

BRIEF DESCRIPTION OF THE DRAWINGS

It will be understood by those of skill in the art that the appended drawings are intended as illustrative of the invention and not intended as limitative thereof.

DETAILED DESCRIPTION OF THE PREFERRED EMBODIMENT

The preferred embodiment of the improved tubular goods slip assembly of the present invention will be described with respect to a slip assembly for use on a drilling rig.

Figure 1:
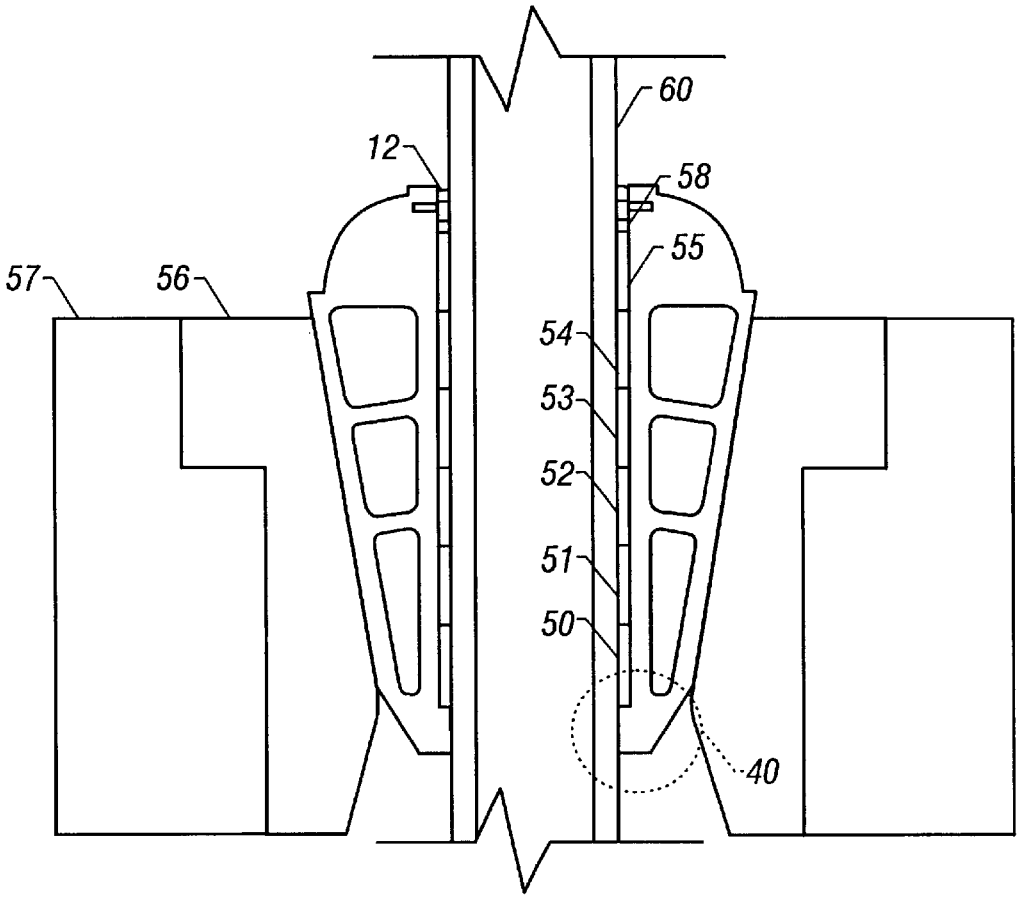
FIG. 1 is an elevated, diagrammatic view of a prior art slip assembly illustrating the critical nose region which tends to crack or otherwise fail in conventional slip assemblies.

FIG. 1 illustrates the prior art critical nose region 40. With a typical conventional slip assembly, there are nine grooves in one horizontal plane for receiving the dies associated with the slip assembly. This concept illustrated in the sectional view illustrated in FIG. 7. Comparing FIG. 7 with FIG. 1 which shows the six dies, 50, 51, 52, 53, 54 and 55 stacked in the vertical position, it is seen that there are a total of 54 dies used in a conventional slip assembly. In the prior art, when the slip assembly such as is shown in FIG. I was used to grip the drill string 60, all of the load was transferred to the lower most set of dies 50 which resulted in a severe loading strain for the nose region 40, and oftentimes resulted in the nose region 40 being cracked and thereafter being unuseable. This was such a severe problem that the slips were checked quite frequently to see if the nose region 40 is cracked, requiring the slip assembly to be replaced with a new one.

Figure 2:
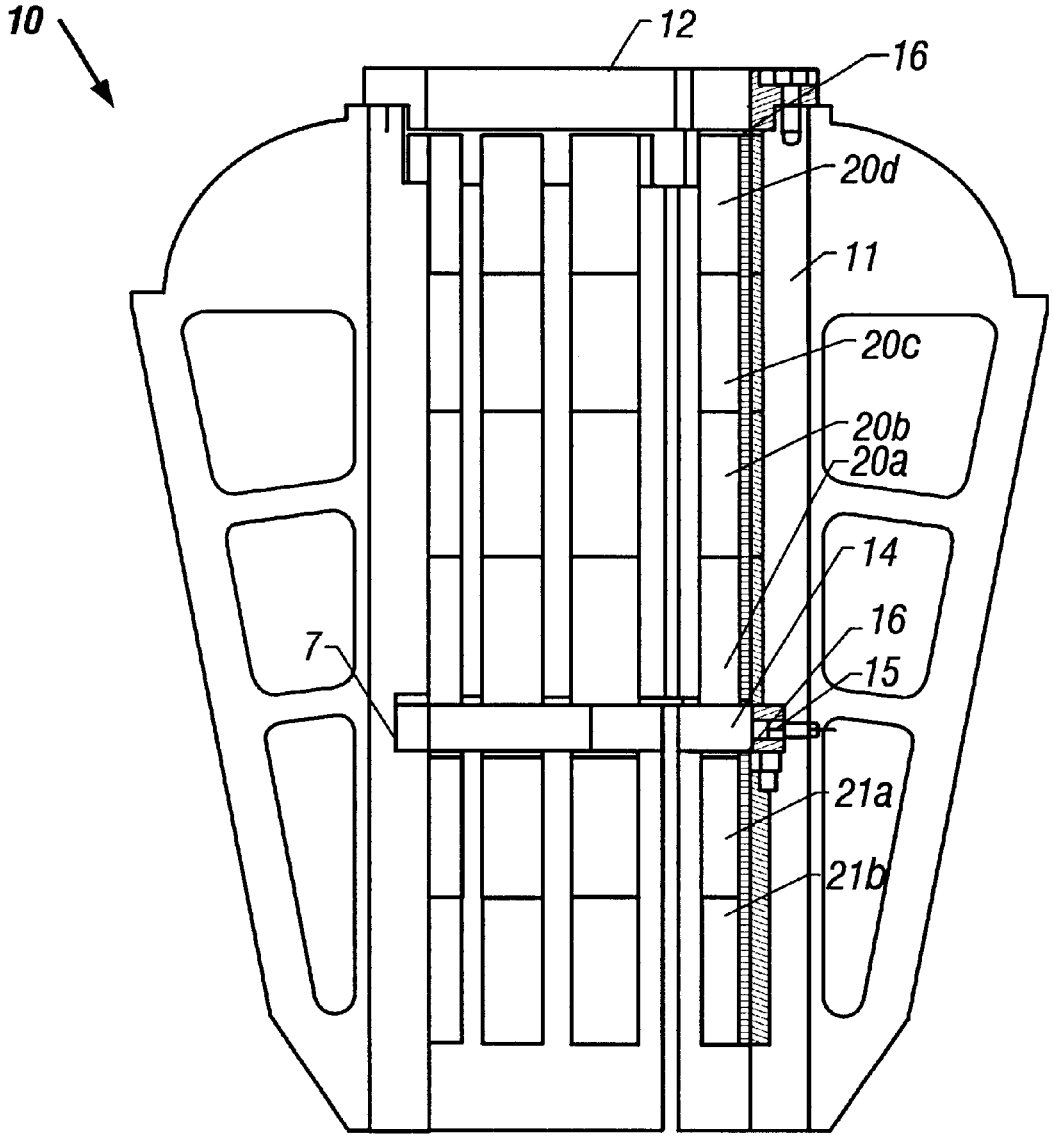
FIG. 2 is a side view partially in section which illustrates the slip assembly complete with segmented load ring and segmented slip sets according to the concepts of the present invention.

Referring now to FIG. 2, a slip assembly for use according to the concepts of the present invention is shown from a side view partially in a section. The assembly shown generally at 10, comprises a plurality of slip segment assemblies used within the bowl 56 such as the bowl of FIG. 1, which would itself be configured within the rotary table 57. The dies 20(*a*), 20(*b*), 20(*c*), and 20(*d*) are separated from the dies 21(*a*) and 21(*b*) in each slip segment by a load ring 14. This will be described in more detail subsequently. In use, the load carried by the upper dies 20(*a*), 20(*b*), 20(*c*) and 20(*d*) in each slip segment is transmitted to load ring 14 by the abutment against this ring of dies 20(*a*) at its lower end. At the top of each of the slip segments is a retainer ring 12 secured thereto by bolts in a conventional fashion, and serves to prevent movement of the slip segments upwardly in operation.

Each load ring 14 comprises a 120° arcuate segment and is attached to a slip segment by load ring retainer bolts 15. Additionally, the load ring 14 is sized to ride in a circumferential groove 17 having a special shape, which will be described in more detail hereinafter, formed or cut into the segmented slips 11. The circumferential groove 17 has a reverse angle lower shoulder, sometimes referred to as being undercut, which is sized to fit a complementary shape on each load ring 14. A set of resilient insert members 16 are placed into holes bored into the top most portion of the lower die 21(*a*) and also into the top most portion of the upper die 20(*d*) which carry resilient inserts 16 into them.

Figure 3:
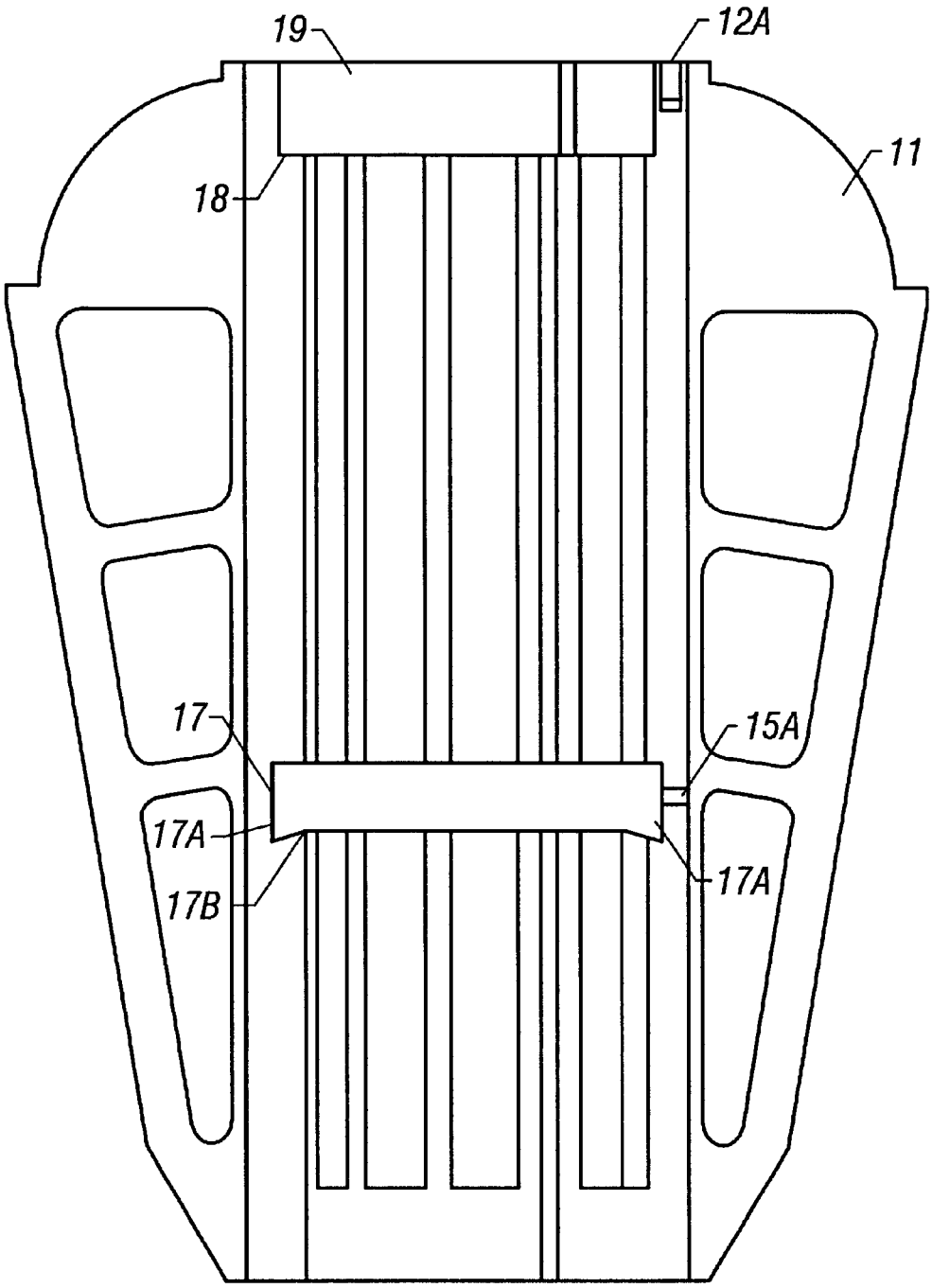
FIG. 3 is a side view partially in section illustrating the slip assembly of the present invention and detailing the retaining groove for the segmented load ring which has a special shape.

Referring now to FIG. 3, the slip segments of the slip assembly are shown in side view without the load ring 14 or the retainer ring 12. A circumferential bore 19 and shoulder 18 are provided about the upper end of the slip segments to carry the retainer ring 12 previously described.

Threaded bolt holes 12(*a*) are provided for receiving the bolts holding retainer ring 12 in place. Additionally, a circumferential shoulder 18 is provided upon which the lower portion of the retainer ring 12 rests when it is bolted into place via the bolts in bolt holes 12(*a*).

A circumferential groove 17 is milled or cut into the slip segments 11 to carry a load ring 14 as previously discussed. Threaded bolt holes 15(*a*) are provided at spaced intervals about the circumference of the slip segments 11 to secure each load ring 14. The shoulders 17(*a*) of circumferential groove 17 are cut at a reverse angle as illustrated. This angle 17(*b*) is preferably in the vicinity of 10°. However, a variance of this angle is within the concepts of the present invention. When the complementary shaped surface 7 of the load ring 14 is placed into the groove 17, the reverse angle shoulder 17(*a*) prevents upward slippage, or tendency to bow or bend, of the load ring 14. This is very important in preventing damage to the tubular goods being handled by the slip assembly 10.

Figure 4A:
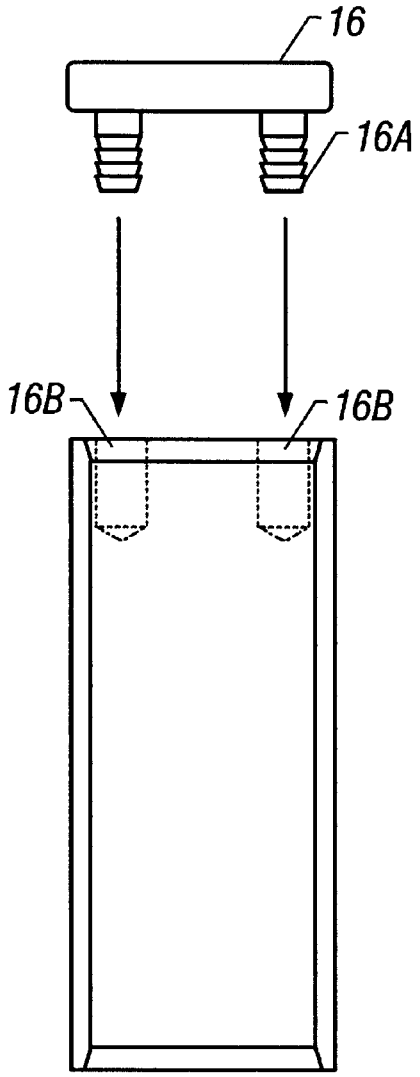
FIGS. 4(*a*) and (*b*) are front and side views of an individual die used in the present invention which illustrates the attaching of the die into the slip segments according to the invention.
Figure 4B:
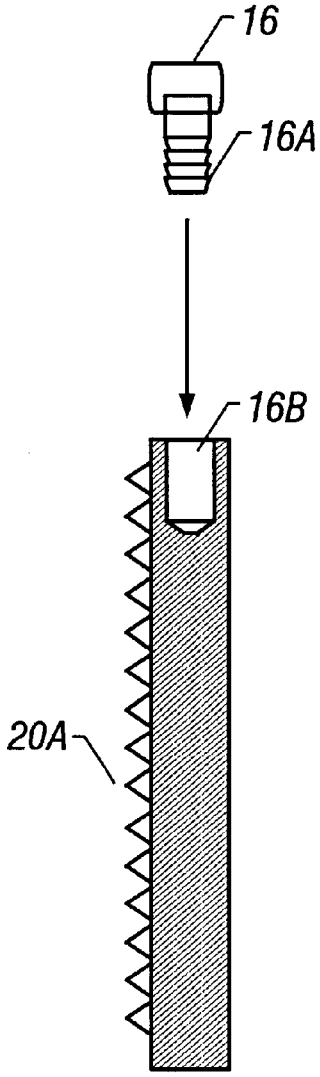
Figure 6A:
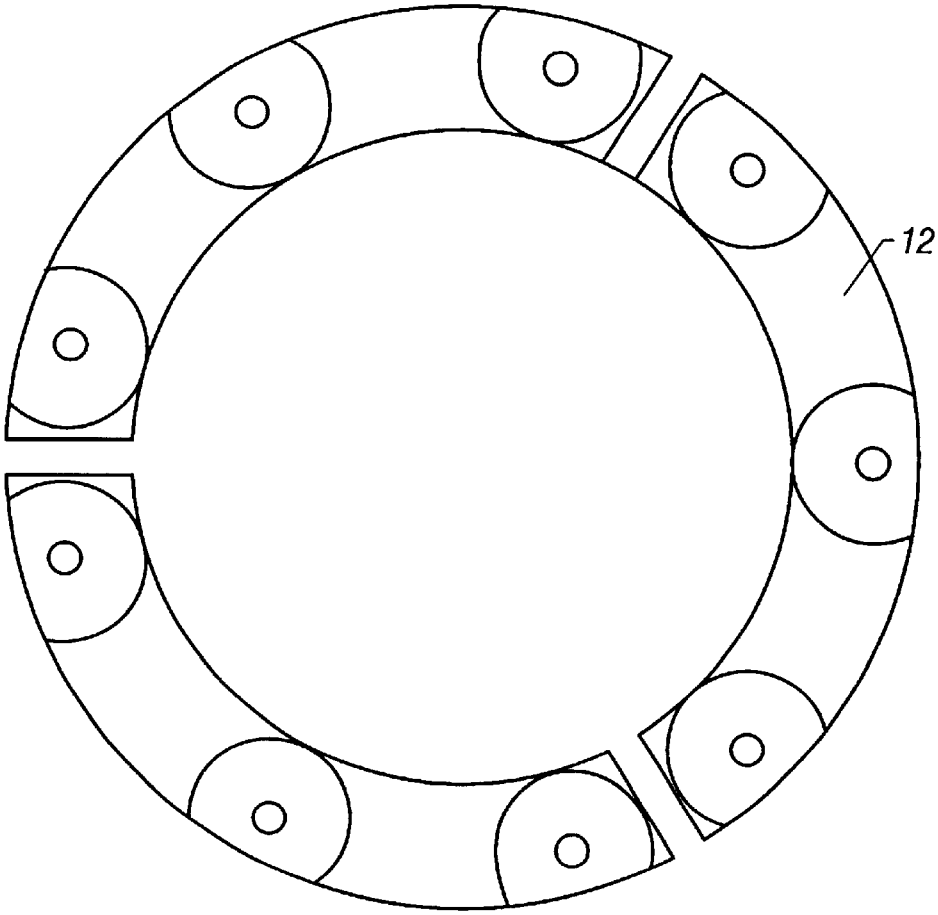
FIGS. 6(*a*) and (*b*) are top and side views, respectively, of the die retainer ring according to the present invention.
Figure 6B:
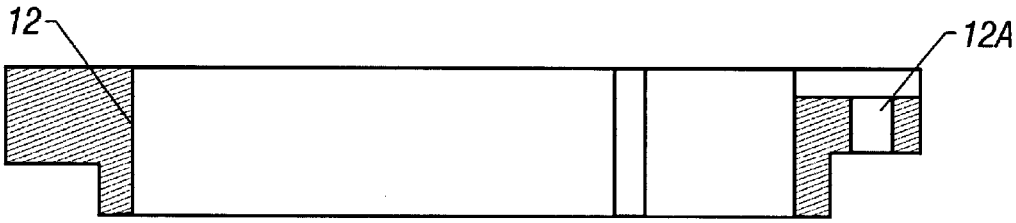

Referring now to FIG. 4(*a*), a back view of die 20(*a*) is shown, while a side view of the same die 20(*a*) is shown in FIG. 4(*b*). While only upper die 20(*a*) is illustrated in FIGS. 4(*a*) and (*b*) it will be understood that the upper dies 20(*b*), 20(*c*), and 20(*d*), as well as the lower dies 21(*a*) and 21(*b*) are configured similarly. Each of the dies 20(*d*) and 21(*a*) is provided with holes 16(*b*) drilled into its upper surface. These holes are sized to snugly receive resilient insert members 16 which have lower gripping leg portions 16(*a*) in extending downwardly therefrom. The use of a pair of legs 16(*a*) in each resilient insert member 16 prevents twisting under load conditions of these members and thus, prevents misalignment of the resilient member 16 from the top portion of dies 20(*d*) and 21(*a*) under loading conditions. The resilient members 16 are formed of a plastic or elastomeric material such as a cured rubber compound or a synthetic plastic such as nylon. When the upper retaining ring 12 (FIGS. 6(*a*) and (*b*) and the load ring 14 are placed into position on the slip segments, the resilient members 16 urge their corresponding dies downwardly in the slip segment from these upper abutting surfaces. This ensures that each of the slip segments is positioned properly and symmetrically in the slip bowl assembly. This symmetrical distribution of the slip segments ensures uniform contact of each of the dies on the exterior surface of the tubular member being held in place by the slip assembly.

Figure 5A:
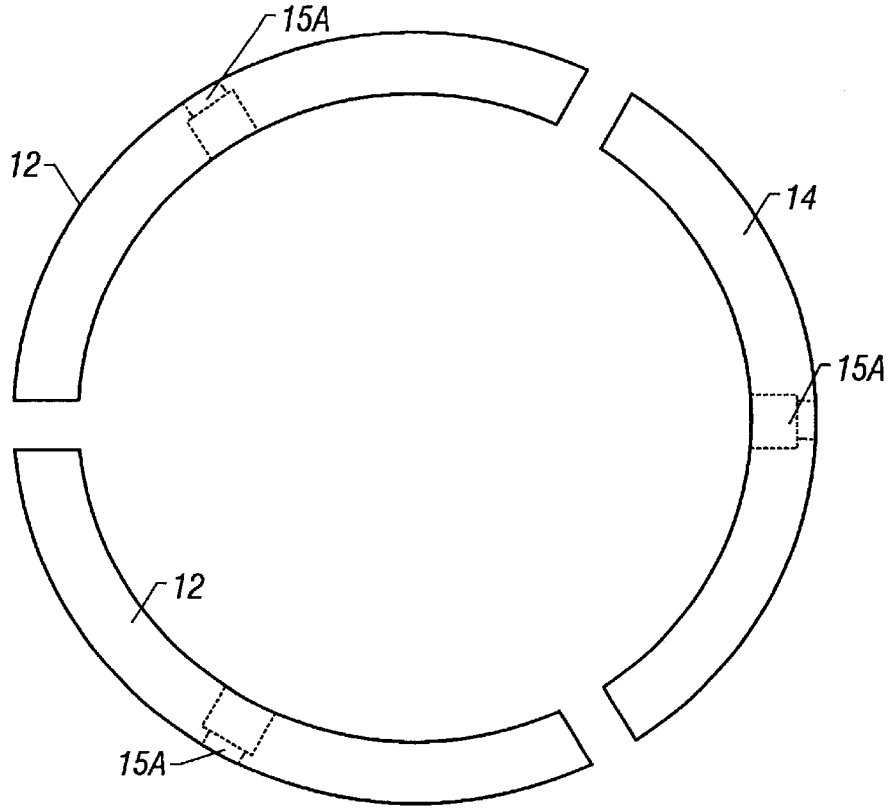
FIGS. 5(*a*) and (*b*) are top side views, respectively of the load rings according to the present invention.
Figure 5B:
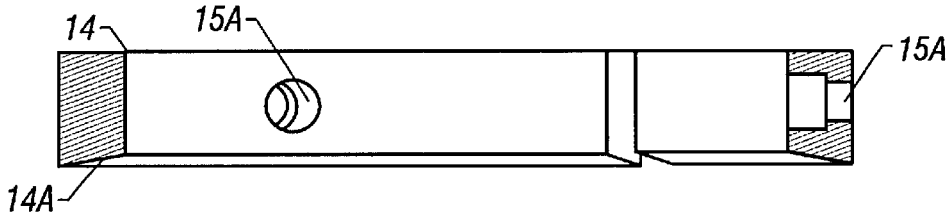

Referring now to FIGS. 5(*a*) and (*b*) the load ring 14, discussed previously, is shown in more detail in top view in FIG. 5(*a*) and in a side view in FIG. 5(*b*). Each load ring 14 comprises a 120° segment as illustrated. Each of the 120° segments is provided with a shaped and shouldered retaining bolt hole 15(*a*). These holes carry the retaining bolts 15 which hold each load ring 14 to its respective slip segment. As shown in the side view of FIG. 5(*b*), the load ring 14 is provided with a complementary surface 14(*a*) which engages the corresponding portion of the circumferential groove 17 cut into the slip segments to receive the segmented load ring. The complementary surface 14(*a*) is kept at a reverse angle, preferably about 10°, to match the undercut portions of the circumferential groove 17 cut into each of the slip segments as previously described.

In understanding the undercut nature of the undercut groove 17 used in combination with the load ring 14, it should be appreciated that the groove is formed such that the lower taper angle on the groove surface in combination with the groove height is insufficient to allow the load ring 14 to be removed perpendicularly from the slip segment. This design requires that each of the load rings 14 be installed in a circumferential direction.

It should also be appreciated that with the slip assembly as illustrated and described herein with respect to FIGS. 2 through 8, the load rings 14 support the load from the four upper dies above the load ring in each axial row of dies. This means that the critical nose section such as the nose region 40 of FIG. 1 carries only the load from the two lower dies of each axial row instead of the normal six dies used in conventional designs. This construction according to the present invention effectively causes much of the load to be shared amongst a greater number of load surfaces.

While only a single load ring 14 is used in each slip segment in the example according to the preferred embodiment of the invention, any number of load rings could be used among the plurality of dies illustrated herein so long as the dies are redimensioned accordingly.

There has also been described herein a more even sharing of load among the axial rows of dies and the employment of the resilient material members on the uppermost die of each axial row and on the upper row of the upper die of each stack of two dies residing immediately below the intermediate segmented load ring 14. The function of each resilient member is to provide a firm downward force on the dies and thus prevent gaps 58 of FIG. 1 from forming between dies which could cause uneven loading of dies as the slips are being set on pipe.

The embodiments illustrated in FIGS. 1 through 8 were tested using overlaid strain gauges from one nose location below an actual row of dies, for example, as illustrated at nose location 40 in FIG. 1. These tests compared the slip assemblies in accordance with the present invention (FIGS. 2–8) with the slip assemblies known in the prior art (FIG. 1), with each configuration being subjected to twenty load cycles of one million pounds on a solid bar the same size as a drill pipe. It was seen that the data points for the prior art configuration displayed a characteristic hysteresis loop as the load was applied and released. The problem with such a configuration in the prior art is that these loops and the maximum observed strains continued to increase with each load application. This was a clear indication that the material in accordance with the configuration of the prior art slip assemblies was incrementally failing. In a sharp contrast, the twenty cycles of strain gauge traces resulting from a test of the slip assembly in accordance with the present invention maintain a much smaller hysteresis loop tending to repeat almost exactly for all twenty load cycles, thus showing that the modifications made to the slip assemblies in accordance with the present invention are extremely effective at preventing failure of the tested material.

In a similar mode, the lower dies 21(*a*) and 21(*b*) are loaded into the slip segments and resilient inserts are used in the top portion of each of the uppermost dies 21(*a*) to work in the identical manner to the manner described above with respect to inserts on the tops of each of the upper dies 20(*d*).

To assemble the apparatus illustrated in FIG. 2, the lowermost dies 21(*b*) are first loaded into the slip segments and then a second set of dies 21(*a*) are loaded on top of the dies 21(*b*). The resilient inserts are then used on the top surface of the dies 21(*a*) to insure that all of the dies 21(*a*) and 21(*b*) are held in place. As soon as the resilient inserts are secured in place below the groove 17, the load ring 14 is then loaded into the groove 17. Since the preferred embodiment contemplates that the groove 17 has an undercut portion, the load ring 14 is assembled from the side of the groove 17. Load ring 14 is then bolted into place using the load ring retainer bolts 15. Thereafter, the uppermost dies 20(*a*), 20(*b*), 20(*c*), and 20(*d*) are loaded into place. Thereafter, the retainer ring 12 is put in place and threaded into the uppermost surface of the die 20(*d*) whereby all of the upper dies are secured in place.

Figure 7:
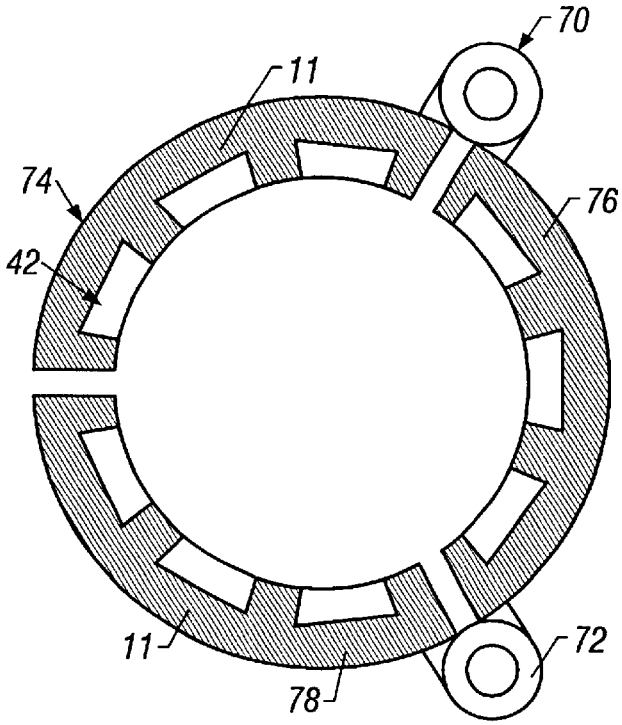
FIG. 7 is a sectional view of the slip assembly used in accordance with the present invention showing a pair of hinges and the individual dovetail grooves into which the dies are loaded.

Referring further to FIG. 7, the slip segments in accordance with the present invention are preferably hinged such as by the hinge 70 and the hinge 72, such that the hinge 70, keeps the slip segment 74 hinged to the slip segment 76 and the slip segment 76 hinged to the slip segment 78. Merely by breaking apart the slip segment 74 from the slip segment 78, the entire assembly illustrated in FIG. 7 can be taken apart.

Figure 8A:
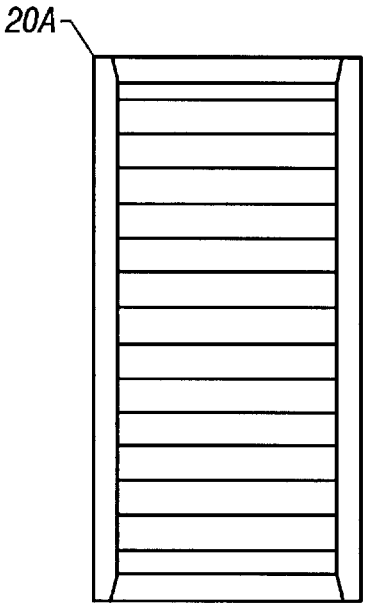
FIG. 8 is a typical hardened die which is used in accordance with the present invention.
Figure 8B:
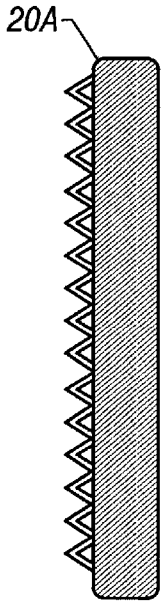
Figure 8C:
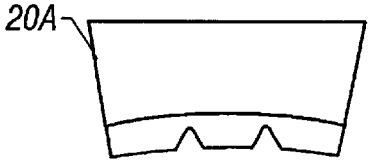

FIG. 8 further illustrates a typical hardened die 20(*a*) with six such dies per slot 42, such as is illustrated in FIG. 2 through FIG. 8, and illustrating further the mating profile to dovetail the die with a particular groove 42.

In summary, the preferred embodiment of the present invention contemplates there being nine dovetail grooves 42 as illustrated in FIG. 7, into which each groove there is located a total of six axially stacked dies.

In each such groove, there are four dies stacked end-to-end and resting against the top of the load ring 14. Two additional dies are stacked in an end-to-end relationship in each of the grooves with the top surface of the uppermost two of the dies being located against the lower surface of the load ring and the lowermost surface of the lowermost die in each groove resting against a shoulder above the nose region 40 such as is illustrated in FIG. 1.

In operation, the slip assembly of the present invention assures a more uniform load distribution due to the resilient members and the use of the load rings. These features assure more positively than the prior art, the proper engagement of each of the dies with the outer surface of the tubular goods being handled.

While the foregoing descriptions have been directed to a preferred embodiment of the invention, it will be understood by those skilled in the art that changes and modifications thereto may be made without departing from the true spirit and scope of the invention. It is the aim of the appended claims to cover all such changes and modifications as filed within the true spirit and scope of the invention.

What is claimed is:

1. A slip assembly for handing tubular goods in a well drilling or workover environment in oilfield operations, comprising:

a slip bowl having upper and lower ends and a tapered inner surface, the inner surface comprising a bore through said slip assembly and having a longitudinal axis and sized for passage of tubular goods;

a plurality of slip segments each of which has a tapered outer surface that conforms to the shape of the slip bowl and a circumferential groove in the inner surface thereof and sized to accept a load ring at a location between said upper end and said lower end of each said slip segment;

a plurality of axially aligned dies located within each of said slip segments, each of said dies having a tubular goods gripping surface facing inwardly towards the longitudinal axis of said bore; and a load ring in said circumferential groove in each slip segment, said load ring separating a set of upper dies in each of said slip segments from a set of lower dies in each of said slip segments, the set of upper dies in each of said slip segments being axially aligned in an edge-to-edge configuration with the uppermost surface of the top dies in the upper set of dies at or near the upper end of said slip bowl assembly and the lowermost surface of the lowest dies in the upper set of dies resting against said load ring, and the set of lower dies being axially aligned in an edge-to-edge relationship such that the upper surface of the top die in the set of lower dies is located near said load ring and the lower surface of the lowest dies in said set of lower dies rests against a shoulder in proximity to the nose region of said slip bowl assembly.

2. The slip assembly of claim 1 and further including:

an upper circumferentially shaped retainer ring attached to each said slip segment at the upper end of said slip segment to retain said dies in said slip segment.

3. The slip assembly of claim 1 wherein said circumferential groove has an undercut lower side.

4. The slip assembly of claim 3 wherein said segmented load ring has a tapered surface shaped complementary to said undercut side of said circumferential groove.

5. The slip assembly of claim 4 wherein said tapered surface of said segmented load ring is tapered at an angle of about 10° with respect to the upper surface of said segmented load ring.

6. The slip assembly of to claim 2, further including a resilient insert between the retainer and the the top dies in the upper set of dies in each of said slip segments, and a resilient insert between the load ring and the top dies in the lower set of dies in each of said slip segments.

7. The slip assembly of claim 6 wherein each resilient insert comprises first and second members in each of said slip segments, and each of said resilient members has at least two downwardly projecting legs.

8. The slip assembly according to claim 7 wherein the top die in the first set of upper dies and the top die in the second set of lower dies in each of said slip segments, respectively, each have at least two receptacle holes in the upper end surface thereof for receiving said downwardly projecting legs.

9. A slip assembly for handling tubular goods in a well drilling or workover environment in oilfield operations, comprising:

(a) a slip bowl having upper and lower ends and a tapered bore therethrough for the passage of a tubular member; and (b) a plurality of slip segments for insertion into the slip bowl, each slip segment comprising: (i) upper and lower ends and an inner surface and a tapered outer surface which conforms to the shape of the inner surface of the bore; (ii) a circumferential groove in the inner segment between the upper and lower ends; (iii) a load ring installed in said groove; and (iv) a plurality of axial rows of dies with gripping surfaces installed in each slip segment, some of the dies in each axial row being installed below the load ring and the remainder of the dies in each axial row being installed above the load ring.

10. The slip assembly of claim 9, wherein it comprises three slip segments.

11. The slip assembly of claim 9, wherein each slip segment comprises three axial rows of the dies.

12. The slip assembly of claim 11, wherein each axial row of dies has six dies and wherein two dies in each axial row are below the load ring.

13. The slip assembly of claim 9, wherein it further comprises a first resilient insert attached to the top of the uppermost die in each axial row of dies and a retainer ring attached to each slip segment above said first resilient inserts and a second resilient insert attached to the top of the uppermost die in each axial row below the load ring.

* * * * *

UNITED STATES PATENT AND TRADEMARK OFFICE

CERTIFICATE OF CORRECTION

PATENT NO. : 6,264,395 B1
DATED : July 24, 2001
INVENTOR(S) : Jerry P. Allamon et al.

It is certified that error appears in the above-identified patent and that said Letters Patent is hereby corrected as shown below:

Column 1,
Line 40, "Into" should be -- into --.

Column 3,
Line 15, "he" should be -- the --.
Line 48, "educe" should be -- reduce --.

Column 4,
Line 65, "I" should be -- 1 --.

Column 6,
Line 10 "*(b)*" should be -- (b)) --.

Column 8,
Line 15, "handing" should be -- handling --.
Line 62, the first occurrence of the word "the" should be deleted.

Column 9,
Line 4, "have" should be -- having".
Line 20, "segment" should be -- surface --.

Signed and Sealed this

Twenty-ninth Day of January, 2002

*Attest:*

*Attesting Officer*

JAMES E. ROGAN
*Director of the United States Patent and Trademark Office*